United States Patent [19]

Stoll et al.

[11] Patent Number: 4,909,048

[45] Date of Patent: Mar. 20, 1990

[54] METHOD FOR PRODUCING INTARSIA KNITTED GOODS AND FLAT-BED KNITTING MACHINE FOR IMPLEMENTING THE METHOD

[75] Inventors: Thomas Stoll; Ernst Goller, both of Reutlingen; Herman Schmodde, Albstadt; Gunther Kazmaier, Johann-Ohnastetten; Albert Ostertag, Reutlingen, all of Fed. Rep. of Germany

[73] Assignee: H. Stoll GmbH & Co., Reutlingen, Fed. Rep. of Germany

[21] Appl. No.: 340,042

[22] Filed: Apr. 18, 1989

[30] Foreign Application Priority Data

Apr. 22, 1988 [DE] Fed. Rep. of Germany ..... 3813504

[51] Int. Cl.[4] ..... D04B 15/52

[52] U.S. Cl. ..... 66/127; 66/128; 66/69

[58] Field of Search ..... 66/69, 127, 128, 125, 66/129, 179

[56] References Cited

U.S. PATENT DOCUMENTS

| | | | |
|---|---|---|---|
| 3,477,254 | 11/1969 | Comas | 66/69 |
| 3,774,413 | 11/1973 | Kemmler | 66/69 |
| 4,052,865 | 10/1977 | Zamarco | 66/127 |
| 4,237,706 | 12/1980 | Patthey | 60/128 |

FOREIGN PATENT DOCUMENTS

| | | | |
|---|---|---|---|
| 2938388 | 4/1981 | Fed. Rep. of Germany | 66/69 |

*Primary Examiner*—Ronald Feldbaum

*Attorney, Agent, or Firm*—Jones, Tullar & Cooper

[57] ABSTRACT

In a method for the production of intarsia knitted pieces on a flat-bed knitting machine, at least some of the yarn guides associated with each one of the intarsia areas and the respective needle bed are moved in a direction relative to each other when one of the needle beds is traversed in both lift directions by a carriage provided with one or a plurality of cams in the border area between two areas of intarsia, and the yarn guides are being coupled with the movement of the carriage in each intarsia area. At the end of a movement segment which extends at most across a number of intarsia areas corresponding to the number of cams, the carriage is reversed in its lift direction and returned, together with the yarn guide last used as well as with the yarn guide to be used for the following intarsia area, to the intarsia area last produced, without making a needle selection. In a further movement segment, a further number of intarsia areas corresponding at most to the number of cams is produced in the original lift direction. Becanuse of this a larger number of intarsia areas or colors can be knitted than corresponds to the number of cams in the carriage used without requiring steps which would reduce the production capacity and increase the costs.

12 Claims, 4 Drawing Sheets

METHOD FOR PRODUCING INTARSIA KNITTED GOODS AND FLAT-BED KNITTING MACHINE FOR IMPLEMENTING THE METHOD

FIELD OF THE INVENTION

The present invention relates to a method for producing intarsia knitted goods on a flat-bed knitting machine wherein, when one of the needle beds is traversed in one and/or the other lift direction by a carriage provided with one or a plurality of cams in the border area between two areas of intarsia, at least some of the yarn guides associated with each one of the intarsia areas and the respective needle bed are moved in a direction relative to each other and the yarn guides are being coupled or uncoupled within the intarsia area with or by means of the movement of the carriage. It also relates to a flat-bed knitting machine for implementing the method, having a carriage with at least one cam for both directions of lift along a needle bed arrangement, with a separate yarn guide for each intarsia area, the yarn guides being capable of being coupled or uncoupled within the intarsia area with or by means of the movement of the carriage, and where the yarn guides and the respective needle bed of the needle bed arrangement can be moved at least partially in a direction in relation towards each other in the border area between two intarsia areas.

BACKGROUND OF THE INVENTION

In such a method or with such a flat-bed knitting machine, known from German Published, Non-examined Patent Application DE-OS 27 30 306, the odd numbered areas of the individual intarsia areas which follow successively in a row of stitches are knitted by a preceding cam of a two-cam carriage and the even numbered areas are knitted by the succeeding cam. The yarn guide is provided with an arm, pivotably fixed on the yarn guide box, the end of which guiding the respective yarn is pivoted in the area between two adjacent intarsia areas out of the needle field of the respective intarsia area at the end of knitting operation and into the needle field of the respective intarsia area prior to the start of a knitting operation.

This is mechanically relatively complicated and expensive because of the multitude of yarn guides which must be used. Because of the pivoting mechanism, the speed possible for the carriage is also limited. Furthermore, mechanical control means must be provided which assure the pivoting of the yarn guides at exactly the corresponding times.

Additionally, in a method or with a flat-bed knitting machine of the type mentioned above, it is known from EP-A1 246 364 to couple the respective yarn guide operationally with a cover, which cover is displaced correspondingly in relation to the needle bed by means of a cable pull connected with the drive.

It is disadvantageous in this case that an additional drive is required to perform such a relative movement between the yarn guide and the needle bed.

Furthermore, a method or a flat-bed knitting machine of the previously described type is known from German Published, Non-examined Patent Application P 29 10 532 and German Published, Non-examined Patent Application P 32 45 233 in which the yarn guides are provided with yarn guide tubelets containing the yarn, which can be moved in a vertical sense in relation to the corresponding needle bed. The intarsia areas are produced according to the plating process, i.e. an overlapping process.

It is disadvantageous in this case that it is necessary to position each needle exactly, that space is limited for the yarn guide tubelets and that this design is limited to certain minimal needle spacings.

However, all of these known methods for producing intarsia knitted goods or of flat-bed knitting machines suitable for such production have the common disadvantage that, in the absence of an acceptance of the need for additional steps, it is only possible to produce as many different intarsia areas or colors as there are cams provided on the carriage used. If more intarsia areas or colors are to be knitted, further efforts or perhaps even the acceptance of idle passages or empty rows is required, depending on the pattern to b knitted, which results in a negative effect on the efficiency of the production.

SUMMARY OF THE INVENTION

It is an object of the present invention to provide a method for producing intarsia knitted goods on a flat-bed knitting machine and a flat-bed knitting machine for implementing the method of the type mentioned above, with which a larger amount of intarsia areas or colors can be knitted than corresponds to the number of cams in the carriage used, without requiring an effort which reduces the productive capacity and increases the costs.

The method and apparatus of the present invention make it easily possible to knit a plurality of colors or intarsia areas in each row of stitches as corresponds to the number of cams used in the carriage. The yarn guides with rigid arms, which have been customarily used and which can be made and used cost-effectively, can be employed. In accordance with the method, it is furthermore advantageously possible to manufacture a plurality of colors or intarsia areas with a carriage having only one cam. Additionally, in this method the movements of elements are used in an advantageous and cost-efficient manner, the drives of which are customarily already provided in a flat-bed knitting machine. This is not only true for the reversible drive of the carriage, but also for the drive of a needle bet displacement. Thus no additional drive elements are required. With all methods it is of advantage that the edge of the pattern can be freely designed without having to take into consideration, as was the case previously, the maximally possible and set pivot path of the yarn guide arm. Not only the short return lift of the reversible carriage, but also the displacement of the needle bed and the shaft can be variably selected and set as to their size.

Further details of the invention can be found in the description below, in which the invention is described in detail by means of the exemplary embodiments shown in the drawings.

DETAILED DESCRIPTION OF THE PREFERRED EMBODIMENTS

Figure 1:
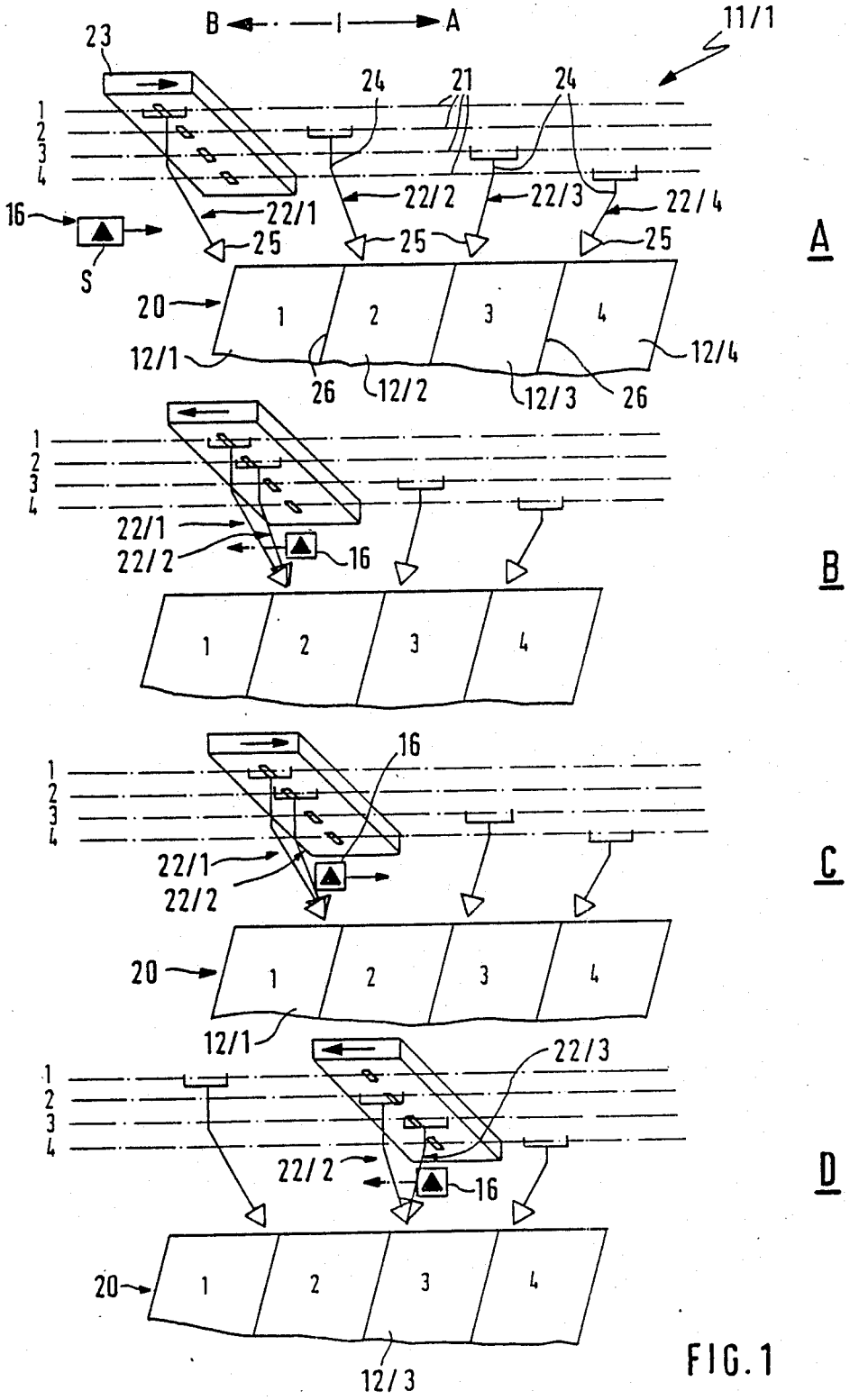
FIG. 1 is a schematic and partial view of the area of a flat-bed knitting machine for producing intarsia knitted goods necessary to explain the invention in accordance with a first exemplary embodiment of the present invention in the form of a single cam-machine.

The flat-bed knitting machine 11/1, 11/2, 11' or 11'', shown schematically in the drawings, in particular by means of the several method steps in accordance with the various exemplary embodiments, is used to produce intarsia knitted goods, the amount of colors or intarsia areas of which is greater and a multiple of the number of cams S provided in a knitting unit or carriage 16, 17, 18 or 19 used, without it being necessary to run idle passages. To the extent that they are not otherwise described, the flat-bed knitting machines 11/1, 11/2, 11' and 11'' are of customary design. Only for reasons of clarity has the carriage 16 to 19 been placed above the needle bed and the yarn guides in the schematic views.

The flat-bed knitting machine 11/1, shown in FIG. 1 has, for example, a V-shaped carriage arrangement, the carriages 16 of which are each provided with a single knitting cam S. The two carriages 16, only one of which is schematically shown, are for example movable back and forth, as is customary, along a V-shaped needle bed arrangement consisting of affront and rear needle bed 20, only one of which is shown. In a manner, also not shown, the carriages 16 are provided with a reversible electric drive in a manner known per se, which makes it possible for the carriages 16, or the carriage arrangement, to reverse their lift direction at optional sites along the needle bed 20, or the needle bed arrangement, without it being required to make a needle selection in the needle bed or without the needles coming under the influence of the cams of the carriage. This can be accomplished, for example, by means of the known pressure cam technique. In the customary manner a yarn guide 22 can be moved back and forth along a plurality, in this case four, parallel guide rails 21. Also in the customary manner, the yarn guides 22 can be optionally connected ad disconnected with the movement of the carriage 16, so that they can be dropped off at optional sites of the needle area along the needle bed 20 and picked up again. The yarn guides 22 have arms 24, which can be connected with a yarn change box 23, through the ends 25 of which, provided with eyes, the respective yarn of the corresponding color is guided. With the aid of this single-cam flat-bed knitting machine 11/1 it is intended to produce an intarsia knitted piece consisting of four intarsia areas f, for example, different colors in the needle areas or needle fields 12/1 to 12/4 shown. It is to be understood that the boundaries or pattern edges between the individual intarsia areas may in general be of optional shape.

According to this exemplary embodiment, the flat-bed knitting machine is equipped with a total of four yarn guides 22 of which, at the beginning of a row of stitches, the yarn guide 22/1 is disposed ahead of the needle field 12/1, assigned to the first intarsia area, the yarn guide 22/2 is on the other side, looking in the direction of lift, of the boundary line 26 between the needle field 12/1 and 12/2. In the same manner as the yarn guide 22/2, the two yarn guides 22/3 and 22/4 are each disposed on the other side of the preceding needle field 12/2 or 12/3, i.e. in the area of the third or fourth intarsia area assigned to them and to be produced by them. This starting position is required, as in the method cited in the state of the art, because for the production of the respective preceding intarsia area the yarn guide to be used for the following intarsia area must be located outside of that needle field, in which the preceding intarsia area is to be knitted. This starting position can be seen in partial FIG. 1A.

If the carriage 16 with the single cam S and together with the first, in the direction of lift, yarn guide 22/1 are moved in the direction of the arrow A, one row of the first intarsia area is knitted in the respective color in the needle field 12/1, the needles being controlled in the customary manner by the cam S in the carriage 16 in one, for example the first, needle bed 20.

The knitting process takes place with the aid of the yarn guide 22/1 across the entire needle field 12/1 which is designed for this intarsia area. However, the first yarn guide 22/1 is taken along as far as the first rest position of the yarn guide 22/2, which is to be used for the following second intarsia area. There the second yarn guide 22/2 is connected with the yarn guide box 23, and the direction of movement of the carriage 16 is reversed. Thus the carriage 16 is returned by a short lift in the direction of the arrow B into the needle field 12/1 for the first intarsia area, at which position the first yarn guide 22/1 rests (Partial FIG. 1B). Then another lift reversal takes place, so that the carriage 16 continues to move in the direction of the arrow A, movably connected with the second yarn guide 22/2, from the position shown in partial FIG. 1C into the position shown in partial FIG. 1D and thus knits a line of stitches for the second intarsia area in the needle field 12/2.

Then the same method step takes place again, i.e. the carriage 16 moves with the second yarn guide 22/2 beyond the boundary 26 of the needle field 12/2 as far as the third needle guide 22/3, takes it and the second yarn guide 22/2 back into the needle field 12/2, leaves the second yarn guide 22/2 there and moves on with the third yarn guide 22/3 in the direction of the arrow A while knitting a row of stitches for the third intarsia area. This type of pilgrim-step movement is repeated until the carriage 16 with the fourth yarn guide 22/4 is disposed beyond the boundary 26 of the needle field 12/4 for the fourth intarsia area. There a lift reversal of the carriage 16 in the direction of the arrow B takes place, so that in this lift direction and in the corresponding reversed way, otherwise as described above, each one of a row of stitches of the fourth to the first intarsia areas is successively knitted in a reverse manner, the carriage 16 moving along the needle bed 20 in accordance with the pilgrim step technique.

A criterion for the size of the respective short reverse lift of the carriage 16 consists in that in the first place the yarn guides vacate the respective succeeding needle area or needle field and, in the second place, at least one needle of the preceding needle area or needle field has been reached to make a connection between the adjoining intarsia areas. For the latter case the lift distance depends on the size of the needle division. The reverse lift distance may be adjustably preset by a control. It may also be possible by means of this control to provide, via adjustable return lift distances, oblique pattern edges between adjoining intarsia areas having pitches of smaller or larger sizes.

Figure 2:
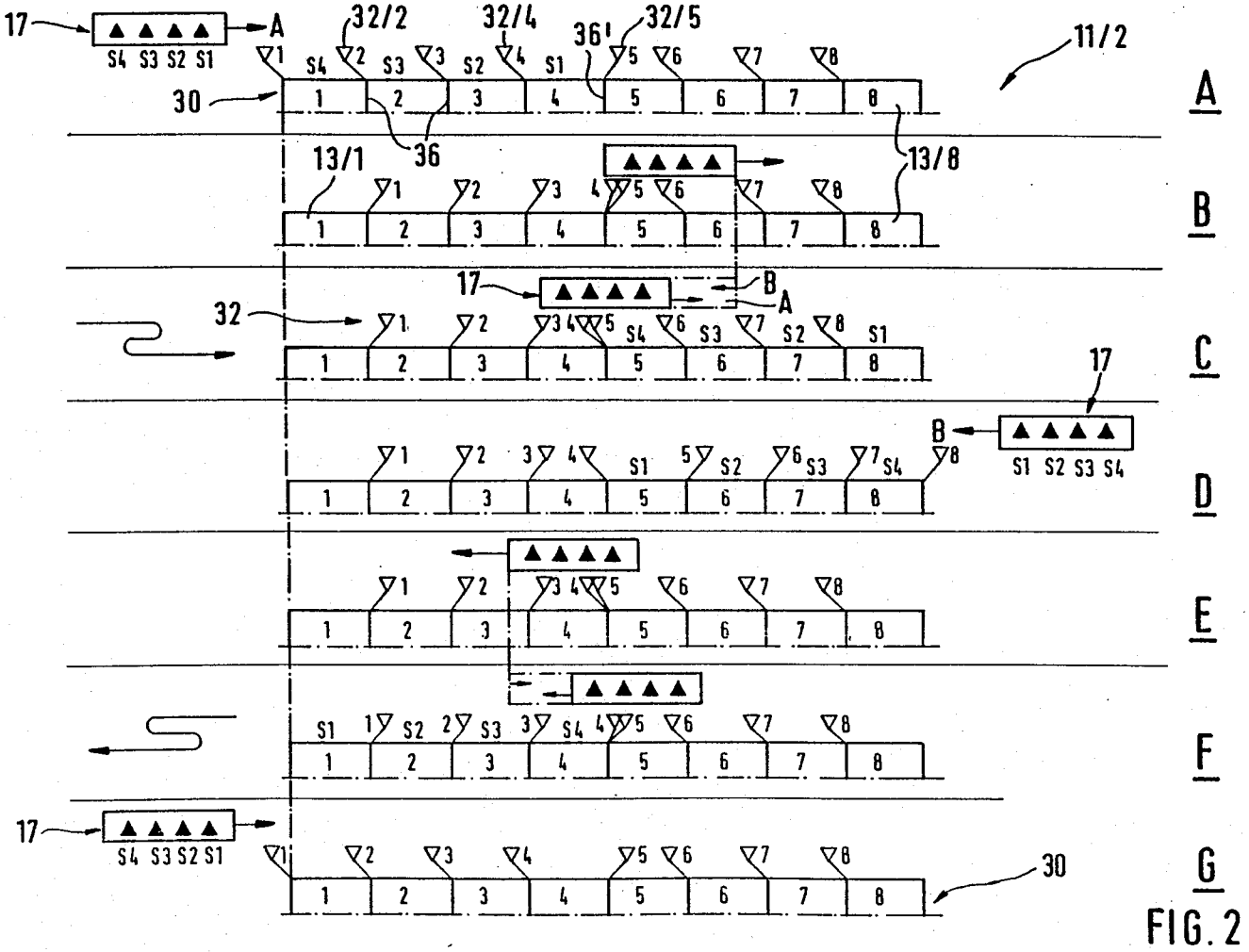
FIG. 2 shows, in a schematic view similar to that of FIG. 1, the various method steps for producing intarsia knitted goods in accordance with the first exemplary embodiment, but in connection with a multi-cam machine.

FIG. 2 generally shows the same method for the production of intarsia knitted pieces along the needle areas or needle fields 13 of a needle bed 30, however, a carriage 17 is used with the flat-bed knitting machine 11/2, which is equipped with a plurality of knitting cams, in his case four, S1 to S4. Such four-cam carriages 17 also are standard items.

In accordance with partial FIG. 2A it is intended to produce, by means of the carriage 17 having four cams S1 to S4, two intarsia area groups of four intarsia areas each along the needle areas or needle fields 13/1 to 13/4 or 13/5 to 13/8, i.e. altogether eight intarsia areas of different colors. Altogether eight yarn guides 32 are provided which are, as in the exemplary embodiment of FIG. 1, movable along or on yarn guide rails and are connectable with the movement of the carriage 17 and disconnectable from it again in a manner not shown. The controllable connecting device for the yarn guides 32 can, in the same way as the one for the yarn guides 22 of FIG. 1, optionally be controllable by bipolar magnets, for example. In the starting position for the production of a row of stitches of an intarsia knitted piece provided with eight intarsia areas, the yarn guides 32 are disposed as shown in partial FIG. 2A, i.e. the yarn guides 32/1 to 32/4 for the first group for the first to the fourth intarsia areas are each disposed in front of the corresponding boundary 36 of the needle field for the respective succeeding intarsia area. This is also true for yarn guides 32/6 to 32/8 for the intarsia areas of the succeeding second group to be produced in the needle fields 13/6 to 13/8, with the exception of the yarn guide 32/5 which is disposed at the transition of the needle fields 13/4 and 13/5 for the first intarsia area group and the second intarsia area group and which is disposed there in the needle area 13/5 for the fifth intarsia area.

With the aid of the carriage 17, having a knitting unit consisting of the four cams S1 to S4, the first through fourth intarsia areas of the first intarsia area group are now knitted in the needle fields 13/1 through 13/4 in such a way, that the first knitting cam S1, which precedes in the direction of movement A, is assigned to the rear, in the direction of movement, needle field 13/4 for the fourth intarsia area of the first intarsia area group, the second cam S2 with the preceding needle field 13/3 for the third intarsia area, the cam S3, operating next to last in the direction of movement, with the needle field 13/2 for the second intarsia area and the succeeding, i.e. last, cam S4 with the front needle field 13/1 for the first intarsia area. In accordance with partial FIG. 2B, the carriage 17 is moved in the direction of movement A until a row of stitches of the first through fourth intarsia areas of the first intarsia area group has been knitted in the needle fields 13/1 to 13/4, so that the individual yarn guides 32/1 to 32/4, assigned to their cams S4 to S1, are successively taken along, starting with the yarn guide 32/4, in such a way that the respectively succeeding yarn guide 32/3, 32/2, 32/1 has been moved out prior to the arrival of the preceding yarn guide 32/1, 32/2 and 32/3. During this movement of the carriage 17 along this first movement sector across the needle fields 13/1 to 13/4, the yarn guides 32/1 to 32/4 are each dropped off on the other side of the boundaries 36 between the corresponding adjacent needle fields, the yarn guide 32/4 being carried along up to the yarn guide 32/5.

As in the exemplary embodiment of FIG. 1, the carriage is then reversed, in accordance with partial FIG. 2C, over a short lift distance, i.e. moved in the direction B, the two yarn guides 32/4 and 32/5 being carried along into the needle field 13/4, in which a row of the fourth intarsia area has been knitted. Then again a lift reversal takes place, so that the carriage 17 is again moved forward in the direction of the arrow A in order to be able to produce a row of stitches of the next, in this case second, intarsia area group with, for example again four intarsia areas, in the needle fields 13/5 to 13/8. The yarn guide 32/4 remains at the place in the needle field 13/4 shown in partial FIG. 2C. As described in connection with the yarn guides 32/1 to 32/4 and the first to fourth intarsia areas, the eighth to fifth intarsia areas are successively knitted and the yarn guides 32/8 to 32/5 are successively taken along and the yarn guides are dropped off in a corresponding manner, as shown in partial FIG. 2D.

Then a further row of stitches is knitted by the four-cam carriage 17 in the opposite direction according to arrow B in the same manner in the two intarsia area groups with four intarsia areas each during passage across the needle fields 13/8 to 12/1, as shown in partial FIGS. 2D to 2G. The pick-up and drop-off of the yarn guides and the association of the cams S1 to S4 to the needle fields for the respective intarsia areas takes place in a correspondingly reverse manner, such as is shown in the above mentioned partial Figs. During knitting in the direction B, too, a short lift reversal of the carriage 17 takes place at the boundary 36' between the two intarsia area groups, i.e. the needle fields 13/5 and 13/4, in order to bring the yarn guides 32/4 and 32/5 out of the needle area 13/4 for the succeeding intarsia area of the succeeding, in this case the first, intarsia area group.

The short lift reversal is, as described in FIG. 1, controlled in a corresponding and desired way, the same as the transition path of the yarn guides 13/1 to 13/4 or 13/5 and 13/6 to 13/8 for the shape of the pattern edge desired there.

Figure 3:
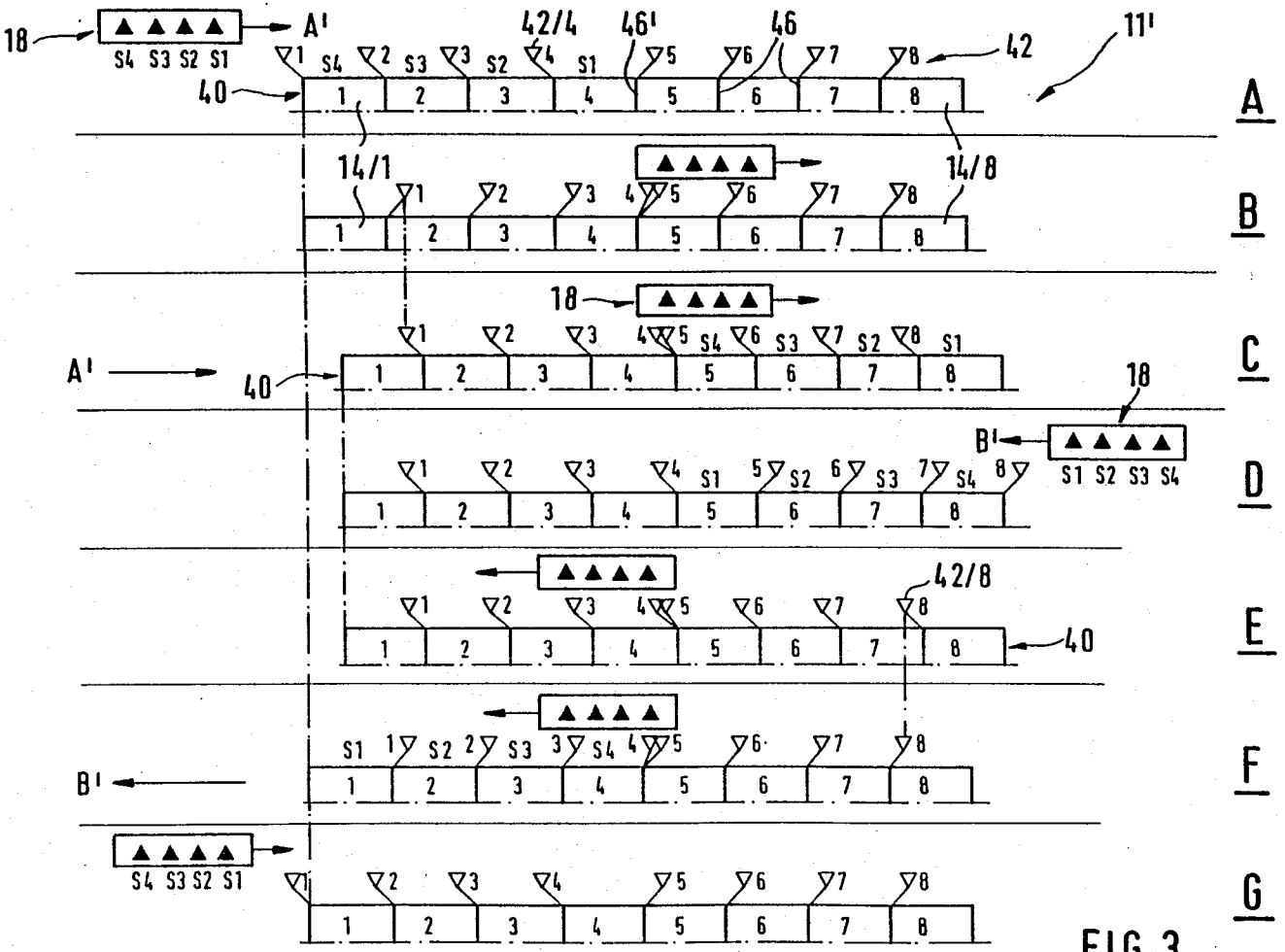
FIG. 3 is a view corresponding to FIG. 2, but in connection with a flat-bed knitting machine for producing intarsia knitted goods in accordance with a second exemplary embodiment of the present invention.

In the exemplary embodiment illustrated in FIG. 3 the flat-bed knitting machine 11' is provided with a carriage 18 in the same manner as in the exemplary embodiment of FIG. 2, which is provided with four cams S1' to S4'. The design of this flat-bed knitting machine 11' and the manner of the assignment of the cams S1' to S4' to the individual needle fields 14/1 to 14/4 and 14/5 to 14/8 of the needle bed 40 for the first to eighth intarsia areas of the two intarsia areas groups is the same as in the exemplary embodiment of FIG. 2, so that in general only the differences relative to the above exemplary embodiment need to be discussed.

The important and, for all practical purposes, only two differences between this exemplary embodiment of FIG. 3 add the exemplary embodiment shown in FIG. 2 consist in that, firstly, in contrast to the yarn guides 42/1 to 42/5, which have the same initial position as the yarn guides 32/1 to 32/5 of the exemplary embodiment of FIG. 2, the remaining yarn guides 42/6 to 42/8 are disposed in the initial position in relation to the yarn guide 42/5, i.e. in the associated needle fields 14/6 to 14/8, and in that, secondly, the relative movement between the yarn guides 42/1 to 42/8 and the associated needle area 14/1 to 14/8 of the corresponding needle bed 40 does not take place by means of the reversal of the carriage 18, but by the corresponding needle bed 40 being displaced in the direction of the arrow A' or B'. In other words, preferably that needle bed 40 is displaced in the directions mentioned which is equipped with a corresponding device for the execution of a needle bed displacement anyway. In general it is possible by this to set the extent of the displacement. Thus, after a row of stitches has been knitted in the first to fourth intarsia areas of the first intarsia area group and the carriage 18 has attained the position shown in partial FIG. 3B, the needle bed 40 is displaced in the direction of the arrow A' in such a way that the yarn guides 42/4 and 42/5 are now disposed in the needle field 14/4 for the fourth intarsia area, instead of in the needle field 14/5 for the fifth intarsia area (partial FIG. 3C). At the same time the yarn guides 42/6 to 42/8 also reach the adjoining needle field 14/5 or 14/6 or 14/6, respectively, as is shown in partial FIG. 3A as initial position of the yarn guides 42/1 to 42/4.

After knitting a row of stitches for the second group of the fifth to eighth intarsia in the needle fields 14/5 to 14/8, a lift reversal of the carriage 18 takes place in accordance with partial FIG. 3D, so that it now moves in the direction of the arrow B' and initially knits a row of stitches of the second intarsia area group. After the carriage 18 has done this in accordance with partial FIG. 3E, another displacement of the needle bed takes place, but in a direction opposite the preceding displacement, i.e. in accordance with arrow B', so that the respective yarn guides 42/1 to 42/4, which have reached the associated needle areas 14/1 to 14/4 with the first needle bed displacement (partial FIG. C), together with the yarn guide 14/5, which is to be dropped off, reach a position in which they are disposed in front of the needle fields 14/1 to 14/4 in the knitting direction B', where a row of stitches is to be produced now for the first to fourth intarsia areas of he succeeding, in this case first, group. Partial FIG. 13G again illustrates the initial position for the start of a further row of stitches in the direction of movement A'.

In this exemplary embodiment the needle bed displacement is preferably performed during the lift movement of the carriage 18 and is synchronized with it, so that stopping the carriage is not necessary. Since both moves are in the same direction, this is possible. In this exemplary embodiment, as well as in the exemplary embodiment according to FIG. 2, cams are used which permit the performance of a relative movement between needle bed and cams without a needle selection. It is possible to use cams as described, for example, in German Published, Non-examined Patent Application DE-OS 35 41 171.

Figure 4:
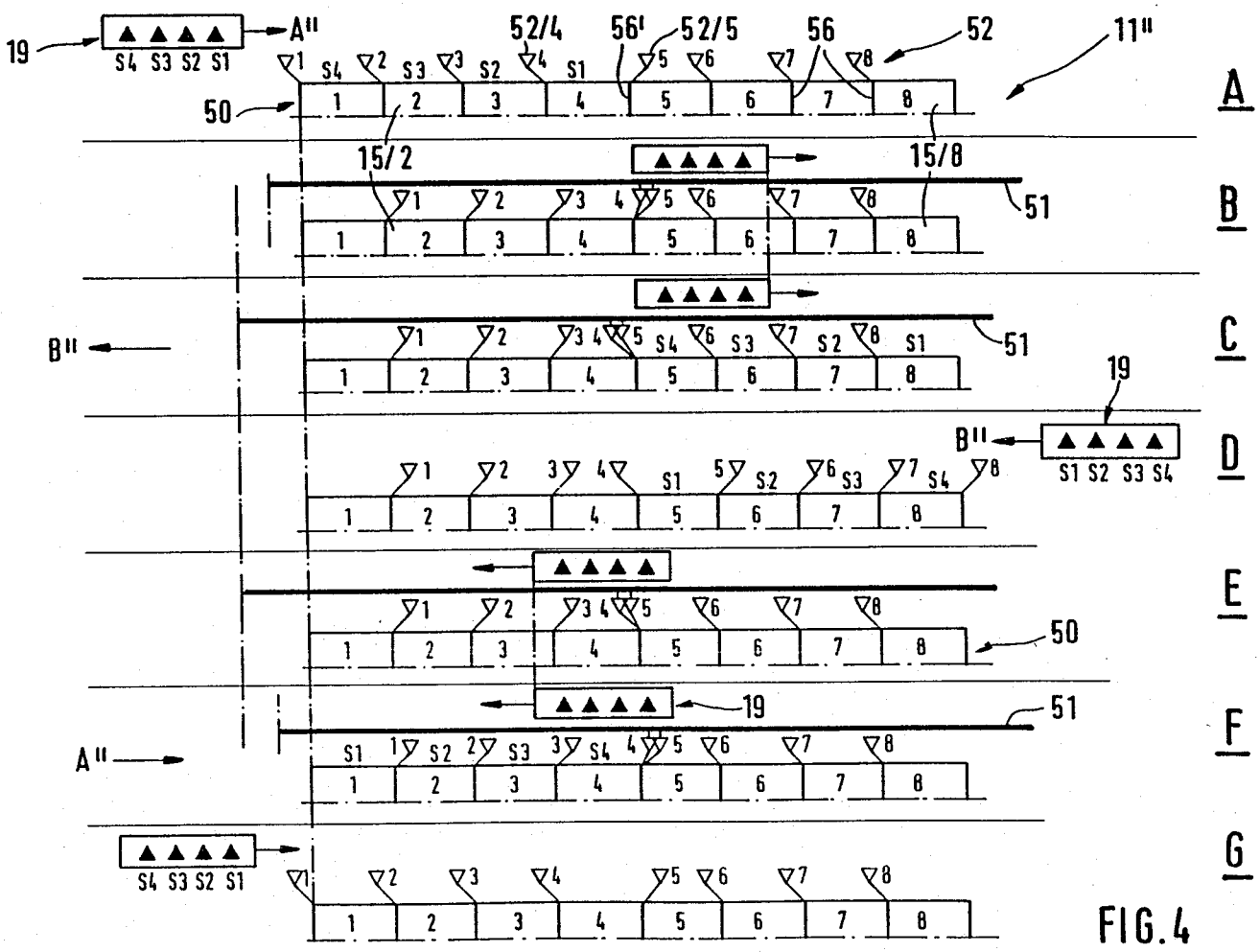
FIG. 4 is a view corresponding to FIG. 2 of a flat-bed knitting machine for producing intarsia knitted goods, but in accordance with a third exemplary embodiment of the present invention.

An exemplary embodiment of a flat-bed knitting machine 11'' is illustrated in FIG. 4 which in general corresponds to those of exemplary embodiments of FIGS. 2 and 3. In general, the only difference from FIG. 2 is that the relative movement between the yarn guides 52/1 to 52/8 and the needle bed 50 or the needle fields 15/1 to 15/8 for the intarsia areas to be produced is performed in yet another way. Here, too, the carriage 19 has a total of four cams S1'' to S4'' and there are eight yarn guides 52/1 to 52/8 provided for producing two intarsia area groups with four intarsia areas each in the needle fields 15/1 to 15/8.

The initial position for the production of a row of stitches in the direction of the arrow A'' corresponds, as far as the position of the yarn guides 52/1 to 52/8 in relation to the needle fields 15/1 to 15/8 for the production of the intarsia areas is concerned, to the exemplary embodiment of FIG. 2. Production of a row of stitches for the first intarsia group in the direction of movement A'' of the carriage 19 takesplace in the way as was described in the exemplary embodiment of FIG. 2. In the transition position of the carriage 19 between the two intarsia area groups in accordance with FIG. 4B, the relative movement between the two yarn guides 52/4 and 52/5 and the needle bed 50 takes place in that one or two parallel yarn guide rails 51, on which the two yarn guides 52/4 and 52/5 can be fixed in this position, is/are displaced in the direction of the arrow B'', i.e. opposite to the carriage direction A'', by a certain amount in such a way, that the two yarn guides 52/4 and 52/5 are moved out of the needle area 15/5 in which the fifth intarsia area of the succeeding second intarsia area group is to be supplied with a row of stitches. In this, as in the other exemplary embodiments, the yarn guide 52/4 is dropped off. At the end of this row of stitches knitted in the direction of the arrow A'' in accordance with partial FIG. 4D, positions of the yarn guides 52/1 to 52/8 in relation to the corresponding needle areas 15/1 to 15/8 result, which correspond to the positions of partial FIG. 2D.

Production of a row of stitches in the direction of movement B'' takes place in a corresponding manner, a longitudinal displacement of the yarn guide rail 51 in the direction of the arrow A'' in accordance with partial FIG. 4E taking place in the transition area of the boundary 56' between the two intarsia area groups in such a way, that the two yarn guides 52/4 and 52/5 are displaced out of the needle field 15/4 of the intarsia area now to be produced into the needle field 15/5 of the intarsia area which already was provided with a further stitch. Then the row of stitches in the needle fields 15/4 to 15/1 for the fourth to the first intarsia area can be successively knitted in the already described manner, while the yarn guide 52/5 remains dropped off.

The displacement of the needle bed 50 or the rail 51 of the exemplary embodiment of FIG. 3 or FIG. 4 can be controlled, adjustable as to its extent, in the same way as the lift reversal of the carriage in accordance with FIG. 1 or FIG. 2.

It should be understood that in the exemplary embodiments of FIGS. 2 to 4 the number of the cams assigned to a carriage as well as the number of the intarsia areas or intarsia area groups to be produced can be generally optional. Accordingly, in place of the eight intarsia areas to be produced shown, it would be possible, for example, to use a two or three cam carriage instead of a four cam carriage. It is to be understood that more than eight intarsia areas may be knitted and that the number of intarsia areas to be produced can be separated into various groups with the same or different numbers of intarsia areas.

We claim:

1. A method for producing intarsia knitted goods on a flat-bed knitting machine, comprising the steps of:

traversing one of the needle beds in one and/or the other lift direction by movement of a carriage provided with least one cam in the border area between two areas of intarsia;

moving at least some of the yarn guides associated with each one of the intarsia areas and the respective needle bed in a direction relative to each other for coupling or uncoupling, within the intarsia area, with or by means of the movement of the carriage;

reversing the movement of the carriage at the end of a movement segment, which extends at most across a number of first intarsia areas to be produced corresponding to the number of cams, and, together with the yarn guide last used as well as with the yarn guide to be used for the succeeding intarsia area, moved back into the intarsia area last produced, without making a needle selection in the needle bed; and producing in a further movement segment in the original lift direction by means of additional yarn guides a further number of intarsia areas, corresponding at most to the number of cams.

2. the method as defined in claim 1, wherein the carriage is provided with a single cam, and wherein the individual intarsia areas are knitted successively in the manner of a pilgrim step movement.

3. The method as defined in claim 1, wherein the carriage is provided with a plurality of cams, wherein the intarsia area of a group of intarsia areas following each other in a row of stitches which is first in the lift direction is associated with the cam which is last in the lift direction, and the intarsia area which is last in the lift direction is associated with the cam which is first in the lift direction, and wherein knitting of the individual intarsia areas in each row of stitches is begun before knitting of the respectively preceding intarsia area is finished.

4. A method for producing intarsia knitted goods on a flat-bed knitting machine, comprising the steps of:

traversing one of the needle beds in one and/or the other lift direction by movement of a carriage provided with at least two cams in the border area between two areas of intarsia;

moving at least some of the yarn guides associated with each of the intarsia areas and the respective needle bed in a direction relative to each other for coupling or uncoupling, within the intarsia area, with or by means of the movement of the carriage;

longitudinally displacing the respective needle bed, at the end of a movement segment made by the carriage, which at most extends across a number o first intarsia areas to be produced corresponding to the number of cams, in such a way that the last yarn guide as well as the yarn guide to be used for the succeeding intarsia areas are disposed in the intarsia area last produced; and producing in a successive further movement segment of the carriage in the same lift direction by means of additional yarn guides, a further number of intarsia areas, corresponding at most to the number of cams 5. The method as defined in claim 4, wherein the intarsia area of a group of intarsia areas following each other in a row of stitches which s first in the lift direction is associated with the cam which is last in the lift direction, and the intarsia area which is last in the lift direction is associated with the cam which is first in the lift direction, and wherein knitting of the individual intarsia areas in each row of stitches is begun before knitting of the respective preceding intarsia area is finished.

6. A method for producing intarsia knitted goods on a flat-bed knitting machine, comprising the steps of:

traversing one of the needle beds in one and/or the other lift direction by movement of a carriage provided with at least two cams in the border area between two areas of intarsia;

moving at least some of the yarn guides associated with each one of the intarsia areas and the respective needle bed in a direction relative to each other for coupling or uncoupling, within the intarsia area, with or by means of the movement of the carriage;

returning into the intarsia area last produced the respective yarn guide rail(s) together with the last used yarn guide as well as the yarn guide to be used for the succeeding intarsia area; and producing in a successive further movement segment of the carriage in the same lift direction by means of additional yarn guides, a further number of intarsia areas, corresponding at most to the number of cams.

7. A flat-bed knitting machine for producing intarsia knitting goods, comprising:

a carriage with at least one cam for both directions of lift along a needle bed arrangement;

a separate yarn guide for each intarsia area, the yarn guides being capable of being coupled or uncoupled within the intarsia area with or by means of the movement of the carriage; and a drive for the carriage which is reversible at optional locations of the needle bed arrangement wherein:

the yarn guides and the respective needle bed of the needle bed arrangement can be moved at least partially in a direction relative to each other in the border area between two intarsia areas;

a lift reversal of the carriage is achieved by the cams without control of a needle selection; and the yarn guides are controllably connected with movement of the carriage.

8. The flat-bed knitting machine as defined in claim 7, further wherein:

the intarsia area of a group of intarsia areas following each other in a row of stitches which is first in the lift direction is associated with the cam which is last in the lift direction, and the intarsia area which is last in the lift direction is associated with the cam which is first in the lift direction.

9. A flat-bed knitting machine for producing intarsia knitting goods, comprising:

a carriage with at least one cam for both directions of lift along a needle bed arrangement;

a separate yard guide for each intarsia area, the yarn guides being capable of being coupled or uncoupled within the intarsia area with or by means of the movement of the carriage; and a device for performing a longitudinal displacement of a needle bed, wherein:

the yarn guides are controllably connected with movement of the carriage.

10. The flat-bed knitting machine as defined in claim 9, further wherein:

the intarsia area of a group of intarsia areas following each other in a row of stitches which is first in the lift direction is associated with the cam which is last in the lift direction, and the intarsia area, which is last in the lift direction is associated with the cam which is first in the lift direction.

11. A flat-bed knitting machine for producing intarsia knitting goods, comprising:

a carriage with at least one cam for both directions of lift along a needle bed arrangement;

a separate yarn guide for each intarsia area, the yarn guides being capable of being coupled or uncoupled within the intarsia area with or by means of the movement of the carriage; and a device for performing a longitudinal displacement of yarn guide rail(s) provided with the yarn guides, wherein:

the yarn guides are controllably connected with movement of the carriage.

12. The flat-bed knitting machine as defined in claim 11, further wherein:

the intarsia area of a group of intarsia areas following each other in a row of stitches which is first in the lift direction is associated with the cam which is last in the lift direction, and the intarsia area which is last in the lift direction is associated with the cam which is first in the lift direction.

* * * * *